US006371386B1

(12) United States Patent
Hoy

(10) Patent No.: US 6,371,386 B1
(45) Date of Patent: Apr. 16, 2002

(54) SOAP DISPENSER

(75) Inventor: John W. Hoy, Olpe, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 09/766,921

(22) Filed: Jan. 22, 2001

(51) Int. Cl.[7] ..... B05B 7/26

(52) U.S. Cl. ..... 239/316; 239/310; 239/407; 239/530

(58) Field of Search ..... 239/310, 316, 239/317, 315, 375, 407, 525, 530, 538, 569, 581.1; 137/872, 876

(56) References Cited

U.S. PATENT DOCUMENTS 1,079,721 A 11/1913 Pungs
1,687,085 A 10/1928 Dow
2,266,902 A 12/1941 Perkins
2,908,445 A 10/1959 Schwartz
3,075,557 A 1/1963 Kuriluk
3,447,753 A 6/1969 Proctor et al.
3,581,998 A * 6/1971 Roche ..... 239/310
4,785,850 A 11/1988 Sanchez
4,858,830 A * 8/1989 Proctor et al. ..... 239/315 X
4,886,212 A 12/1989 Proctor et al.
6,164,496 A * 12/2000 Gregory ..... 239/316 X

* cited by examiner

*Primary Examiner*—Steven J. Ganey
(74) *Attorney, Agent, or Firm*—Hovey Williams LLP

(57) ABSTRACT

A soap dispenser (10) for providing and controlling flow and mixture of a liquid, such as water, and an agent or media, such as soap, useful in various applications, including, for example, cleaning a vehicle or other object or surface. The dispenser (10) broadly comprises a grip (12) and a body (14) in a rotatably coupled relationship, with the body (14) defining a soap reservoir (47). A first grip end (20) of the cylindrical grip (12) is adapted to connect to a water supply source, such as a common garden hose. A second grip end (22) is coupleable with the body (14) so as to be rotatable in relation thereto. The grip (12) provides a first control surface (24) having a flow channel (26). The body (14) is also cylindrical and provides a second control surface (44) having a single large orifice (46) and a plurality of flow holes (48,49), each of which is rotatably alignable with the channel (26) of the first control surface (24). Thus, the grip (12), control surfaces (24,44), and body (14) combine to provide a plurality of rotatably selectable flow paths for controlling flow rate and mixture.

13 Claims, 4 Drawing Sheets

SOAP DISPENSER

BACKGROUND OF THE INVENTION

1. Field of the Invention

The present invention relates to cleaning apparatuses for providing and controlling flow and mixture of a liquid and an agent. More particularly, the invention relates to a soap dispensing apparatus connectable to a water supply source and operable to provide a flow of water and control mixing thereof with an internally-stored supply of a cleaning agent.

2. Description of the Prior Art

It is sometimes desirable to introduce a cleaning agent, such as soap, into a flow of water, as, for example, when washing a vehicle. Typically, this is accomplished using a soap dispensing system comprising a soap reservoir coupled to a water supply such that the water, as it flows, mixes with soap stored in the reservoir.

Those with ordinary skill in the art will appreciate that many existing soap dispensing systems inconveniently require that the soap dispenser be disconnected when no soap is desired, as when rinsing. Further, many existing systems do not allow for flow rate control, and are designed such that soap is dispensed or mixed into the water flow at such a high rate that the soap reservoir is quickly depleted. Those that do provide flow control typically use complicated and expensive knob- or lever-actuated internal valves prone to wear and breakage.

Due to the above identified and other problems in the art, a need exists for an improved soap dispensing apparatus providing more efficient and convenient control of delivery and mixture of a liquid, such as water, and an agent, such as soap.

SUMMARY OF THE INVENTION

The soap dispenser of the present invention overcomes the problems in the art to provide a simple, efficient, and convenient apparatus for providing and controlling flow and mixture of a liquid, such as water, and an agent or media, such as soap, useful in various applications, including, for example, cleaning a vehicle or other object or surface. The preferred soap dispenser broadly comprises a grip and a body in a rotatably coupled relationship, with the body providing or defining an internal soap reservoir. A first grip end of the cylindrical grip is adapted to connect to a water supply source, such as a common garden hose. A second grip end is operable to couple with the body so as to be rotatable in relation thereto. The second grip end provides a first control surface having a flow channel comprising a plurality of grooves. The body is also cylindrical, and provides a second control surface having a single large orifice and plurality of flow holes, each of which is rotatably alignable with the channel and grooves of the first control surface. Thus, the grip, control surfaces, and body combine to provide a plurality of rotatably selectable flow paths for controlling the flow rate and mixture of water and soap.

The novel use of rotatably alignable control surfaces for providing a plurality of selectable flowpaths provides a convenient flow and mixture control mechanism with numerous advantages over the existing art. For example, in contrast to the knob- and lever-actuated valve systems of the existing art, the present invention requires only one moving part. Thus, the present invention provides a simpler, less costly and easier to use soap dispenser than was previously available.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENT

Figure 1:
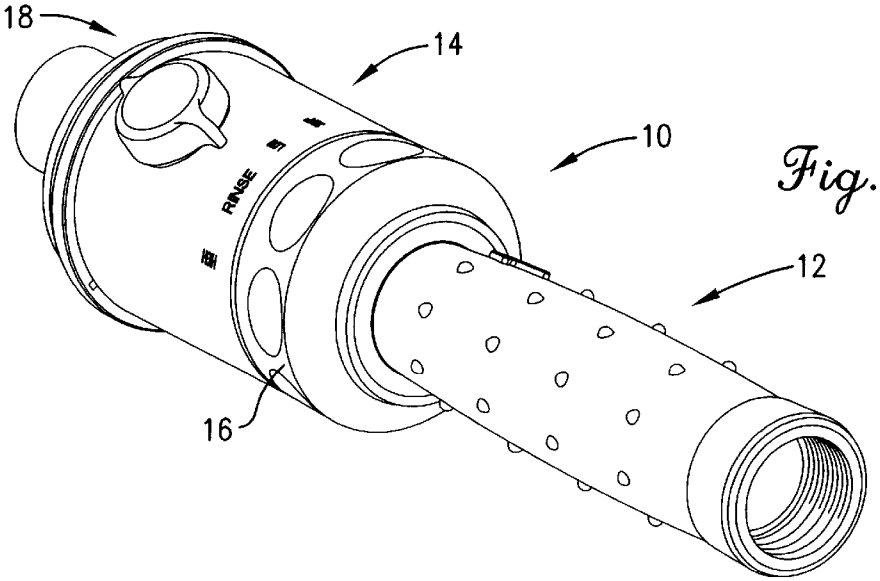
FIG. 1 is a perspective view of a preferred embodiment of the soap dispenser of the present invention.

Referring to FIG. 1, a soap dispenser 10 is shown constructed in accordance with a preferred embodiment of the present invention and operable to provide and control flow and mixture of a liquid, such as water, and an agent, such as soap, useful in various applications, including cleaning a vehicle or other object or surface. The soap dispenser 10 broadly comprises a grip 12; a body 14; a coupling nut 16; and an end cap 18.

Figure 3:
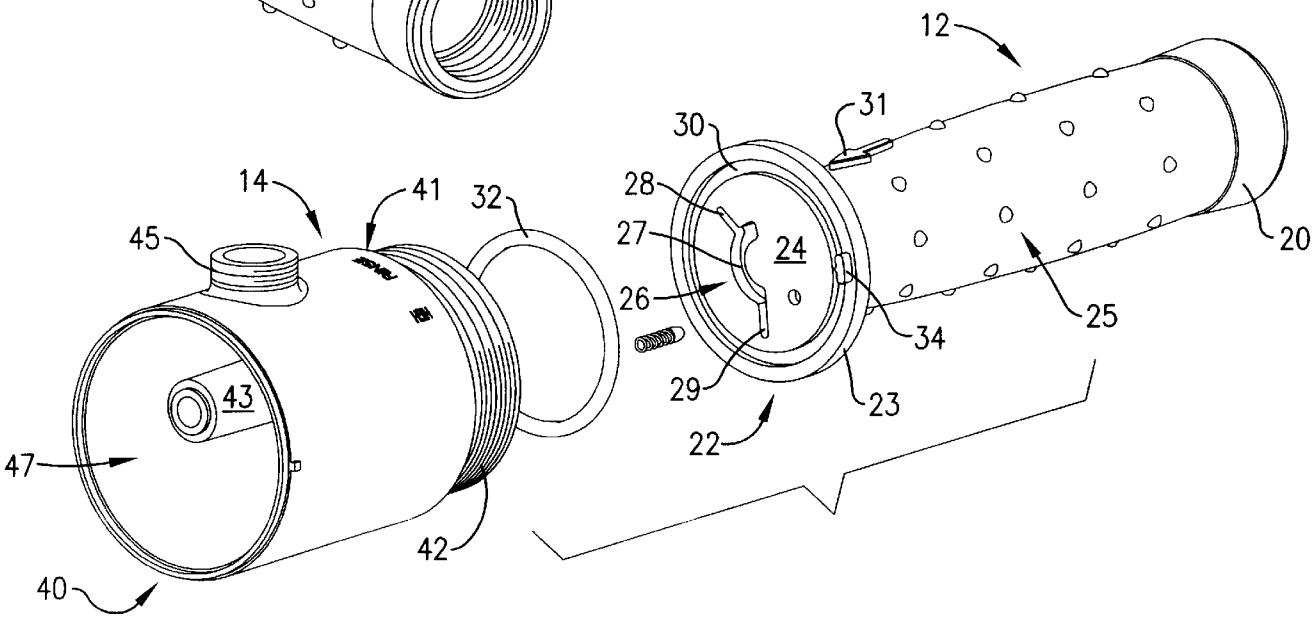
FIG. 3 is a first isometric view of two of the major components of the soap dispenser of FIG. 1.
Figure 2:
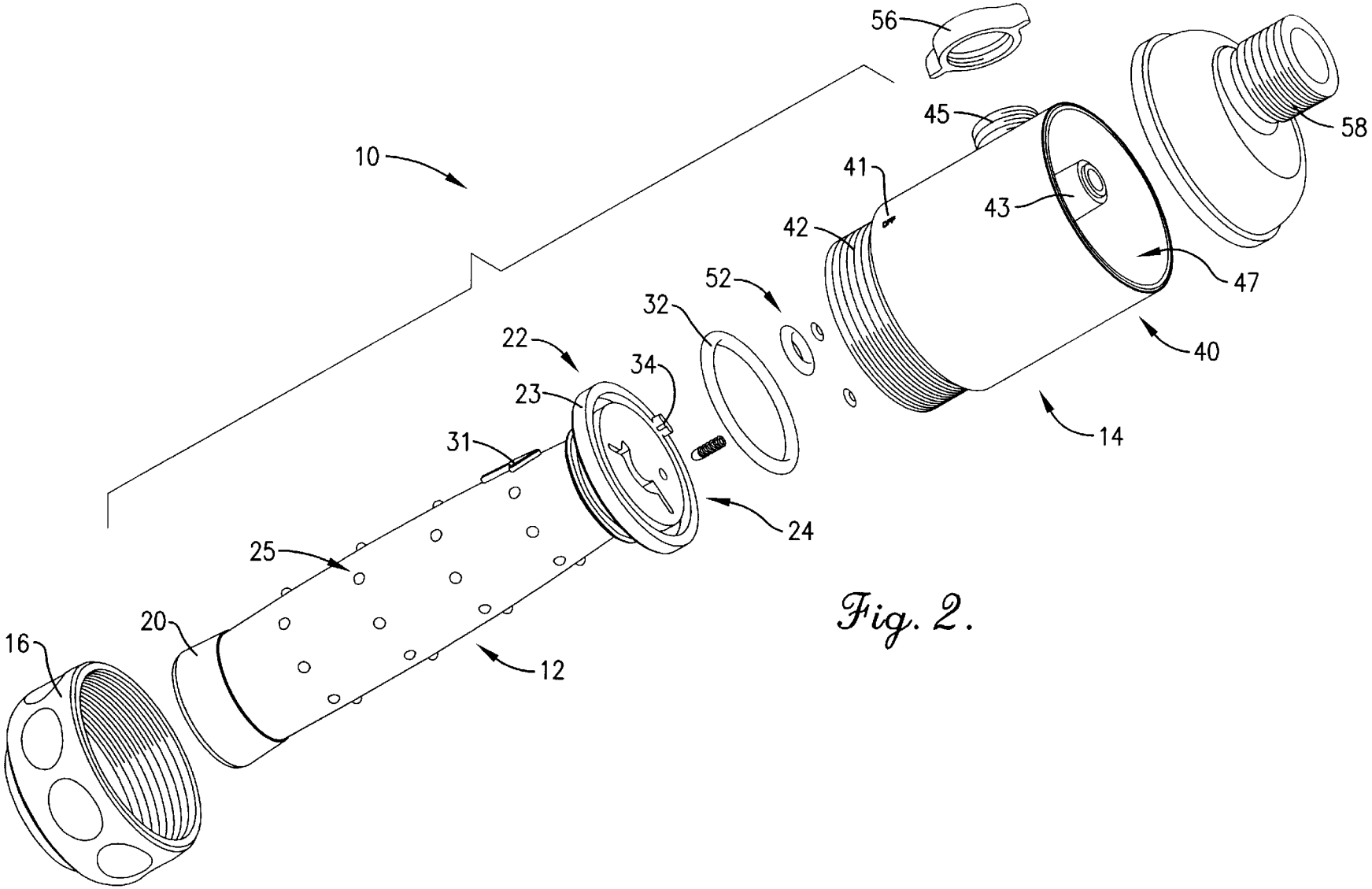
FIG. 2 is an exploded view showing the major components of the soap dispenser of FIG. 1.

Referring to FIGS. 2 and 3, the grip 12 provides a control member suitable for handling by an operator using the soap dispenser apparatus 10. The grip 12 is preferably cylindrical in shape, hollow, and sheathed in a non-slip material having raised portions 25 for easier handling when wet or slippery. An arrow 31 or other indicator is molded into or printed upon the grip 12 so as to allow convenient determination of the grip's rotational position relative to the body 14.

The grip 12 further comprises first and second grip ends 20,22. The first grip end 20 is adapted to removably couple with a water supply source. In a preferred embodiment, for example, the first grip end 20 is threaded to receive the male end of a conventional garden hose. The second grip end 22 presents a circular lip 23 engageable by the coupling nut 16, as described below. The second grip end 22 further presents a first control surface 24.

The first control surface 24 includes a channel 26 cut completely therethrough, and forms one half of a control mechanism for controlling the flow and mixture of soap and water within the dispenser 10. The channel 26 is formed of one major groove 27 and two minor grooves 28,29, with the major groove 27 extending semi-circularly about the major axis of the grip 12, and the minor grooves 28,29 linearly extending radially outward from substantially opposite ends of the major groove 27.

The first control surface 24 further comprises an O-ring groove 30 and a tang 34. The O-ring groove 30 is a circular groove let into the periphery of the control surface 24 and operable to receive and retain a conventional O-ring seal 32 for preventing leakage. The tang 34 rises perpendicularly from the control surface 24 and, as described below, cooperates with portions of the body 14 to maintain proper alignment of the grip 12 and body 14. The tang 34 includes a rounded protrusion 35 which further cooperates, as is also described below, with certain body portions to facilitate function control.

Figure 4:
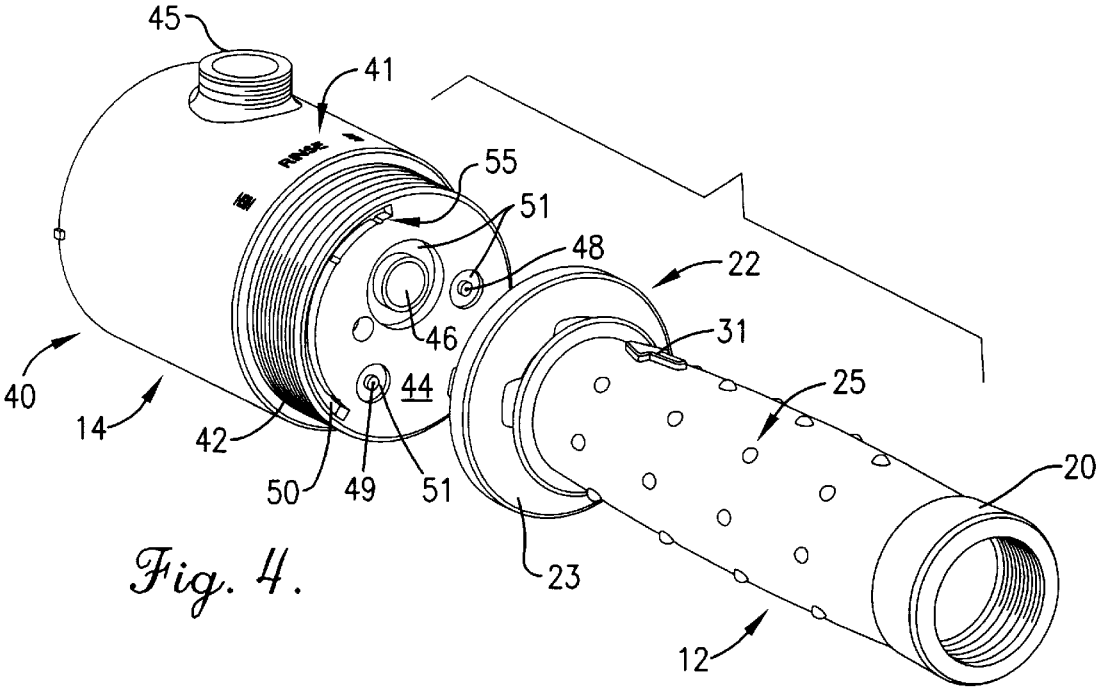
FIG. 4 is a second isometric view of the two major components shown in FIG. 3.

Referring to FIGS. 2 and 4, the body 14 defines, in conjunction with the cap 18, a soap reservoir 47. The soap reservoir 47 also serves as a mixing chamber when the grip 12 and body 14 are aligned so as to include the soap reservoir 47 in the water flowpath, thereby introducing the water to and mixing it with the soap in the reservoir 47. The body 14 is preferably cylindrical, having substantially the same diameter as the circular lip 23 of the second grip end 22, and includes first and second body ends 40,42.

Indicators 41, preferably lettering, are molded into or printed upon the body 14 to, in combination with the arrow 31 of the grip 12, communicate the rotational alignment of the body 14 relative to the grip 12. These indicators 41 preferably take the form of lettering such as HIGH, LOW, and SOAP, and OFF so that a user need only align the arrow 31 with the appropriate indicator 41 to achieve a desired function.

The soap reservoir portion 47 of the body 14 is preferably made of transparent plastic so that the amount of soap remaining in the reservoir 47 can be more easily determined. The body 14 further includes an outlet tube 43; a second control surface 44; and a fill port 45. The first body end 40 is adapted to securely couple with the cap 18, as described below. The second body end 42 is adapted to threadably engage the coupling nut 16.

The outlet tube 43 allows the water or soap and water mixture to exit the dispenser 10. The outlet tube 43 is an elongated cylinder extending through the body 14 and soap reservoir 47 parallel to the body's major axis, connected at a first end to the second control surface 44 and coupleable at a second end with the cap 18.

The second control surface 44 is similar in size and shape to the first control surface 24, and comprises a single large orifice 46 and two flow holes 48,49. The large orifice 46 is alignable with the major groove 27 of the channel 26 of the first control surface 24 and opens into the outlet tube 43. The flow holes 48,49 are approximately 0.030 inches in diameter and alignable with the minor grooves 28,29 of the channel 26. There are preferably at least two second holes 48,49, with one providing an entrance for introducing water into the reservoir 47 and another providing an exit for releasing the resulting soap and water mixture therefrom.

The second control surface 44 further comprises a guide groove 50 and three O-ring grooves 51. The O-ring grooves 51 surround the orifice 46 and the flow holes 48,49 to receive and retain conventional O-rings 52 for preventing leaks. The guide groove 50 extends semi-circularly about a portion of the periphery of the second control surface 44, and corresponds to and receives the tang 34 of the first control surface 24. The surface of the guide groove 50 includes one or more indentations 55 corresponding to various operating positions of the dispenser (e.g., off, soap-mix, rinse) and operable to receive the tang protrusion 35. Thus, the tang 34 and guide groove 50 operate together to maintain alignment of the first and second control surfaces 24,44 and limit relative rotation therebetween.

Referring again to FIGS. 1 and 2, the fill port 45 is a closable access opening allowing convenient addition and removal of soap to and from the reservoir 47. The fill port 45 is preferably threaded to receive a conventional cap 56, though any alternative closure mechanism may be used where practical and desirable.

The coupling nut 16 is adapted to securely couple the grip 12 with the body 14 so as to bring the first and second control surfaces 24,44 into operative contact while allowing relative rotation therebetween. The coupling nut 16 is preferably operable to fit over the grip 12 so as to simultaneously engage both the lip portion 23 of the second grip end 22 and the threaded second body end 42. Tightening the coupling nut 16 on the second body end 42 brings the first control surface 24 into compressive contact with the second control surface 44. Because the coupling nut 16 does not otherwise engage the grip 12, the grip 12 remains rotatable relative thereto.

The end cap 18 is adapted to close the soap reservoir 47 at the first body end 40. The cap 18 is preferably non-removably sonically-welded to the body 14, though, in another contemplated embodiment, may be removable. The end cap 18 includes a nozzle 58 alignable with and corresponding to the outlet tube 43. The nozzle 58 is preferably adapted to couple with a cleaning tool (not shown), such as a brush head or handle.

Viewed as a whole, a plurality of rotatably selectable flowpaths are created within the assembled soap dispenser 10. Liquid enters the dispenser 10 through the first grip end 20, flows through the grip 12, and meets the first control surface 24. The channel 26 of the first control surface 24 is alignable with the orifice 46 and flow holes 48,49 of the second control surface 44 to provide either mixing or non-mixing flowpaths. Via the mixing flowpath, the liquid exits the grip through the channel 48 and enters the reservoir 47 through one of the flow holes 48, mixes with soap in the reservoir 47, exits through the other flow hole 49, flows along the channel 26 into the orifice 46, through the outlet tube 43, and out the nozzle 58. Via the non-mixing flowpath, the liquid exits the grip 12 through the channel 26 into the orifice 46, through the outlet tube 43, and out the nozzle 58.

In operation, an operator may view, through the clear plastic body 14, the level of soap or other cleaning agent in the reservoir 47, and remove the soap cap 56 and add soap as necessary to fill the reservoir 47 of the otherwise assembled soap dispenser 10. The operator may then couple the first grip end 20 to a garden hose or other water supply source.

Figure 5:
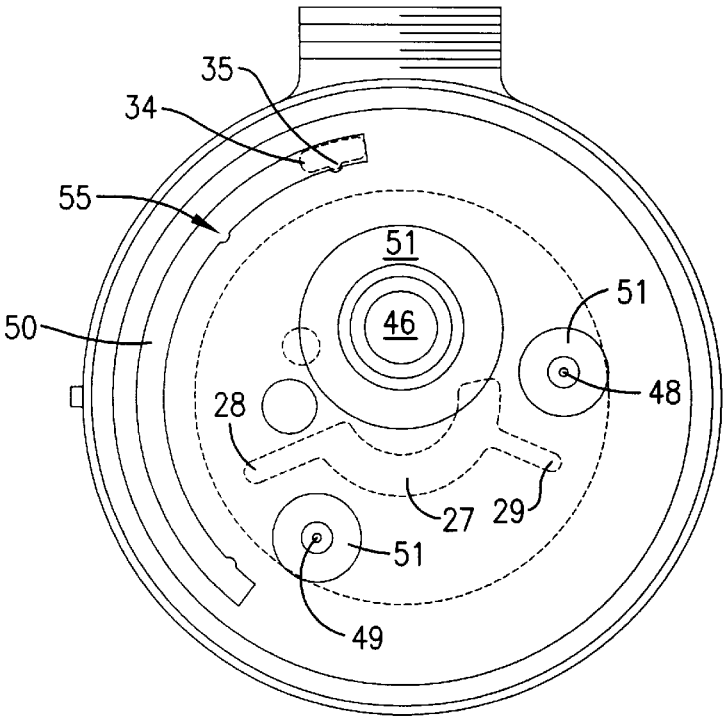
FIG. 5 is an overlay view showing a first operational relationship between the two control surfaces of the soap dispenser of FIG. 1.

Holding the dispenser 10 by the grip 12 and body 14, the operator may rotate the grip 12 relative to the body 14 in order to selectively control flow and mix characteristics of the liquid flowing through the dispenser. Alignment of the grip arrow 31 with one of the body indicators 41 communicates to the operator the selected function. FIG. 5 shows the rotational relationship between the first and second control surfaces 24,44 corresponding to an "off" mode which allows for no water flow and no mixing. This is because the channel 26 of the first control surface 24 aligns with neither the orifice 46 or the flow holes 48,49 of the second control surface 44, and therefore no complete flowpath exists through the dispenser 10. In this position, the tang 34 is located at a first extreme end of the guide groove 30.

Figure 6:
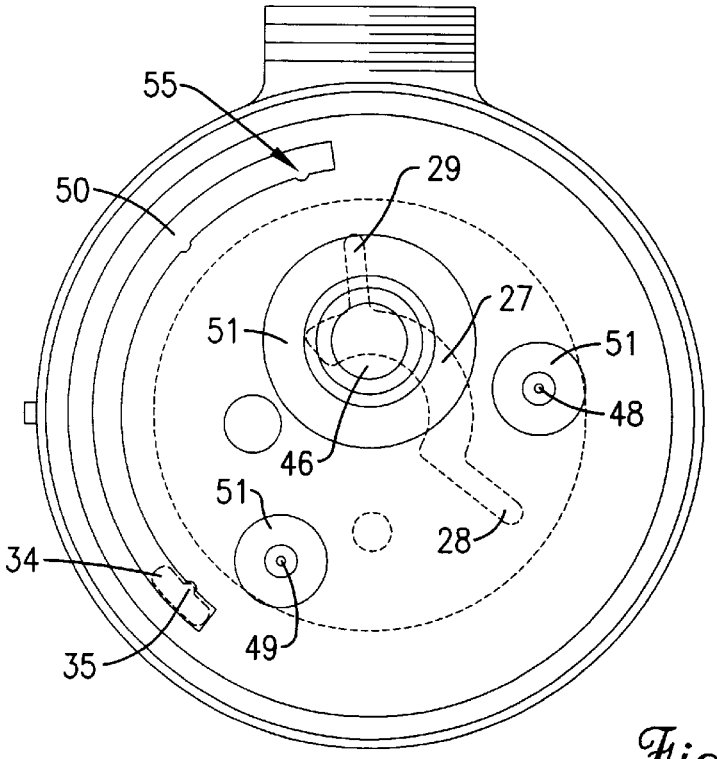
FIG. 6 is an overlay view showing a second operational relationship between the two control surfaces of the soap dispenser of FIG. 1.

FIG. 6 shows the rotational relationship between the first and second control surfaces 24,44 corresponding to "rinse" mode which allows for full water flow but no mixing. The channel 26 aligns fully with the orifice 46 providing a direct flowpath for water entering the grip 12 to exit the nozzle 58 of the cap 18. In this position, the tang 34 is located at an second extreme end of the guide groove 30.

Figure 7:
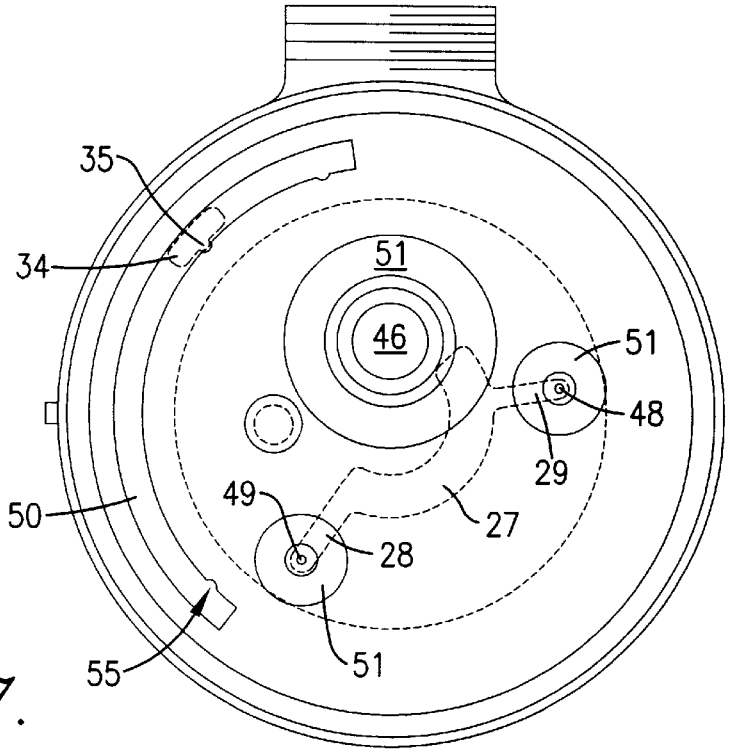
FIG. 7 is an overlay view showing a third operational relationship between the two control surfaces of the soap dispenser of FIG. 1.

FIG. 7 shows the rotational relationship between the first and second control surfaces 24,44 corresponding to "soap"

mode, which allows for mixing of soap and water. The channel 26 aligns fully with the flow holes 48,49 allowing water flowing into the grip to enter the soap reservoir 47 through one flow hole 48, exit the reservoir 47 through the other flow hole 49, and then exit the dispenser 10 through the orifice 46. In this position, the tang 34 is located at an intermediate position in the guide groove 30.

As can be understood by a broad examination of FIGS. 5, 6, and 7, only one rotational relationship or position results in mixing of water and soap. All other rotational relationships result in a degree of water flow ranging from zero (off, shown in FIG. 5) to maximum (full rinse, shown in FIG. 6). Thus, by rotating the grip 12 relative to the body 14, an operator is able to control both water flow rate and mixing. The present invention, however, should not be considered limited to these particular relationships. Changes in the size, number, or location of the channel, orifice, or holes are contemplated which result in different flow and mixture control relationships than those illustrated and described above. The number and effect of the various possible flowpaths is matter of design choice.

From the preceding description, it can be seen that the soap dispenser of the present invention provides a simple, efficient, and convenient to use apparatus for providing and controlling flow and mixture of a cleaning agent and water in a manner useful in a variety of applications, such as, for example, cleaning a vehicle. Although the invention has been described with reference to the preferred embodiment illustrated in the attached drawings, it is noted that equivalents may be employed and substitutions made herein without departing from the scope of the invention as recited in the claims. For example, various shapes and materials may be used to construct the components of the dispenser, and a large number of flowpaths providing different effects than those illustrated or described are possible. Furthermore, the present invention is for a dispenser independent of any particular application or liquid or mix agent or media.

Having thus described the preferred embodiment of the invention, what is claimed as new and desired to be protected by Letters Patent includes the following:

1. An apparatus for controlling flow rate of a liquid and mixing of the liquid with an agent to result in a mixture, the apparatus comprising:

a first component connectable to a liquid supply source and presenting a first control surface having at least one first opening;

a second component rotatably coupled with the first component and presenting a second control surface having at least one second opening, the second component providing an exit for releasing the liquid and mixture from the apparatus; and a reservoir coupled with the second component and operable to contain the agent;

wherein one or more of the first openings are rotatably alignable with one or more of the second openings so as to provide a plurality of rotatably selectable flowpaths through the apparatus, with at least one of the flowpaths avoiding the reservoir and at least one of the flowpaths including the reservoir.

2. The apparatus as set forth in claim 2, the first component being substantially cylindrical and sheathed in a non-slip material.

3. The apparatus as set forth in claim 1, the second component being substantially cylindrical and sheathed in a non-slip material.

4. The apparatus as set forth in claim 1, the first component being adapted to threadably couple with a hose.

5. The apparatus as set forth in claim 1, the reservoir being constructed of a substantially transparent material.

6. The apparatus as set forth in claim 1, the reservoir including an access opening and corresponding cap for adding agent to the reservoir.

7. An apparatus for controlling flow rate of a liquid and mixing of the liquid with a cleaning agent to result in a mixture, the apparatus comprising:

a grip connectable to a liquid supply source and presenting a first control surface having a channel cut therethrough; and a body rotatably coupled with the grip and presenting a second control surface having a plurality of second openings, the body defining a reservoir for the agent and a nozzle for releasing the liquid and mixture;

wherein the grip may be rotated relative to the body so that the channel is selectively alignable with one or more of the second openings to provide a plurality of rotatably selectable flowpaths through the apparatus, with at least one of the flowpaths avoiding the reservoir and at least one of the flowpaths including the reservoir.

8. The apparatus as set forth in claim 7, the grip being substantially cylindrical and sheathed in a non-slip material.

9. The apparatus as set forth in claim 7, the grip having a plurality of raised portions.

10. The apparatus as set forth in claim 7, the grip being adapted to threadably couple with a hose.

11. The apparatus as set forth in claim 7, the body being constructed of a substantially transparent material.

12. The apparatus as set forth in claim 7, the body including an access opening and corresponding cap for adding cleaning agent to the reservoir.

13. The apparatus as set forth in claim 7, further including a removable nut operable to rotatably couple the grip with the body.

* * * * *